United States Patent [19]

Glodowski et al.

[11] Patent Number: 4,589,934

[45] Date of Patent: May 20, 1986

[54] GRINDING ROD AND METHOD FOR PRODUCTION THEREOF

[75] Inventors: Robert J. Glodowski, Middletown, Ohio; Vernon C. Van Slyke, Raytown, Mo.

[73] Assignee: Armco Inc., Middletown, Ohio

[21] Appl. No.: 295,685

[22] Filed: Aug. 24, 1981

[51] Int. Cl.[4] ..... C21D 9/00

[52] U.S. Cl. ..... 148/145; 148/39; 148/152; 148/153

[58] Field of Search ..... 148/143, 145, 152, 153, 148/39, 128, 156

[56] References Cited

U.S. PATENT DOCUMENTS 3,533,261 10/1970 Hollander et al. ..... 148/156

3,756,870 9/1973 Kasper et al. ..... 148/152

*Primary Examiner*—R. Dean

*Attorney, Agent, or Firm*—Frost & Jacobs

[57] ABSTRACT

A rod having end portions of a hardness characteristic of a pearlitic microstructure, the remainder comprising an annular outer region and a core region, at least the outer region having a surface hardness greater than Rockwell C 50. A method of producing heat treated rods involves passing a heated rod through at least one quench zone, initiating a liquid quench after the leading end of the rod has emerged from the quench zone and turning off the liquid quench before the trailing end of the rod enters the quench zone.

17 Claims, 7 Drawing Figures

GRINDING ROD AND METHOD FOR PRODUCTION THEREOF

BACKGROUND OF THE INVENTION

This invention relates to improved heat treated rods, such as grinding rods, for use in conventional rotating grinding mills or rod mills wherein material such as ore, stone and the like is comminuted, and to a method for production of such improved grinding rods by variable quenching. More specifically, the improved grinding rod of the present invention comprises a monolithic cylindrical member of high carbon or alloy steel which is heat treated to obtain a martensitic microstructure over most of its length having a Rockwell C surface hardness greater than 50 (and a softer core region), but with relatively soft end portions having a substantially pearlitic microstructure which minimize spalling and splitting thereof and reduce breakage and wear of rod mill liners.

The prior art has disclosed cylindrical rods having soft cores with the soft cores being exposed only at each end or base of the cylinder. In all such structures of which applicants are aware, the core is of a different type of metal than the outer, harder shell. Thus, U.S. Pat. No. 1,016,272, to Johnson, discloses a rod having a core of soft or wrought iron or soft steel and a surrounding body of hard chilled iron or steel which is cast or fused around the soft core.

U.S. Pat. No. 1,398,970, to Leddell, discloses a rod comprised of a plurality of plugs "which may be of a cheap grade of steel" and an outer sleeve or tube which is a "high grade steel". The plugs are held in place frictionally within the tube by shrinking the tube upon the plugs, or by pressing or hammering the assembly on opposite sides thereof to an out of round configuration.

U.S. Pat. No. 1,661,567, to Floyd, discloses a rod-like structure having a plurality of abrasion resistant steel sleeves in alignment with axial polygonal openings extending therethrough, and a steel core having surfaces inserted through the sleeves, the core having threaded ends on which nuts are engaged to hold the sleeves in assembled relation.

In its broadest aspect the method of the present invention involves the concept of variable quenching by passing a heated, elongated metallic article in a path of travel through at least one liquid quench zone, applying a liquid quench medium to a selected segment or segments along the length of the article, and turning off the liquid quench medium when the remaining segment or segments pass through the quench zone. In the case of an elongated steel article heated above the $A_3$ point, quenching a selected segment or segments rapidly to a temperature below the Ms point results in transformation of the austenitic microstructure to martensite with consequent increase in hardness, in known manner. To the best of applicants' knowledge the above concept has never been applied to the heat treatment of grinding rods, although the prior art has suggested the concept of variable quenching by methods different from that of the present invention, of product forms such as pipes, axle shafts and the like.

U.S. Pat. No. 2,879,192, to Gogan, discloses a method and apparatus for quenching a heated workpiece in which the workpiece is wholly submerged in the quench liquid, and a portion of the workpiece is shielded from contact with the liquid, thus maintaining a void space around the shielded portion, with a cooling air flow being directed thereagainst. The method is indicated to have particular utility for heat treatment of an axle shaft having a bolt flange since it is desirable that the metal of the flange, particularly at the junction of the flange and shaft portions, be hardened to a lesser extent in order to avoid brittleness.

U.S. Pat. No. 3,140,964, to Middlemiss, discloses a method of hardening metal pipe in which a cover plate having a hole therein is welded to one end of a pipe length, and the heated pipe is passed through a quenching zone with the covered end trailing. The vent hole in the cover plate is alleged to permit flame and hot gases to enter the interior of the pipe during heating, to permit hot air and gases to leave during quenching and to admit a controlled quantity of quench water to the interior of the pipe, thus providing a cooling rate sufficient to obtain a required metallurgical structure.

U.S. Pat. No. 3,189,490, to Scott, discloses a process and apparatus for reducing cracking of the trailing end of pipe due to quench spray entering the pipe interior before the trailing end has had extended quenching. Means is provided operable by the trailing end of each pipe section to move spray quench nozzles in the direction of travel of the pipe section when the trailing end reaches a preselected position prior to entry into a fluid spray zone. Means is also provided to return the spray nozzles to their original position after the preselected movement so that when the trailing end of the pipe section approaches the spray zone the nozzles will not spray fluid internally of the pipe until the trailing end has had extended quenching. Since the spray nozzles are angled in the direction of pipe travel, quench fluid does not enter the leading end of the pipe section.

U.S. Pat. No. 3,671,028, to Hemsath, discloses a quench system in which a barrier is provided on the front of the unit to prevent quench liquid from splashing into the open leading end of a heated pipe section which is being quenched. The barrier may be a gaseous jet stream or a shield made of heat resistant material.

It is evident that the prior art summarized above does not contemplate nor deal with the problem of heat treating grinding rods in such manner as to obtain high surface hardness but at the same time to avoid spalling and splitting of the ends thereof and to reduce breakage and wear of rod mill liners.

It is a principal object of the invention to provide an improved grinding rod and method for making it which solves the above problem.

In accordance with the present invention, a heat treated rod comprises a monolithic, elongated, cylindrical high carbon or alloy steel member the end portions of which have a hardness characteristic of a substantially pearlitic microstructure, the remainder of the member intermediate the end portions comprising an annular outer region and a core region, at least the outer region, which has a surface hardness greater than 50 on the Rockwell C scale, being a substantially fully martensitic microstructure. When the rod is intended for use in a grinding mill, the core region has a hardness characteristic of a pearlitic microstructure.

In a preferred embodiment wherein a grinding rod is fabricated from high carbon steel, the hardness of the end portions ranges from about 35 to about 50 on the Rockwell C scale, the surface hardness of the annular outer region ranges from about 55 to about 60 on the Rockwell C scale, and the hardness of the core region ranges from about 30 to about 45 on the Rockwell C scale. The end portions include the entire base surfaces of the cylindrical member and the regions immediately adjacent the base surfaces which merge gradually into the annular outer region.

In its broadest aspect the invention provides a method for variable quenching of an elongated metal article, comprising the steps of heating the article to a desired temperature, passing the article in a linear path of travel through at least one liquid quench zone, detecting the position of the leading end of the article prior to entering the quench zone, initiating a liquid quench spray in the quench zone in response to said step of detecting the position of said leading end after a predetermined length of the article has passed into the quench zone, turning off the liquid quench spray in the quench zone after a further predetermined length of the article has passed into the quench zone, repeating said initiating step in any subsequent liquid quench zone after said predetermined length of said article has passed into each said zone, and repeating said turning off step in each subsequent zone after said further predetermined length of the article has passed into each zone.

A method of producing rods, in accordance with the invention, comprises the steps of providing a monolithic, high carbon or alloy steel elongated cylinder, heating the cylinder above the $A_3$ point, passing the cylinder in a linear path of travel at a predetermined speed through a plurality of successive, axially aligned water quench zones, initiating a water spray in the first of said quench zones after the leading end of the cylinder has emerged therefrom, turning off the water spray in the first quench zone before entry of the trailing end of the cylinder thereinto, repeating said initiating step in each subsequent water quench zone after said leading end of said cylinder has emerged from each said zone, repeating said turning off step in each subsequent water quench zone before said trailing end of said cylinder has entered each zone, detecting the position of the leading end of the cylinder prior to entering the first of said water quench zones, and initiating said water spray in each of said quench zones after a predetermined linear length of travel of the cylinder responsive to said step of detecting the position of the leading end.

DETAILED DESCRIPTION

Figure 1:
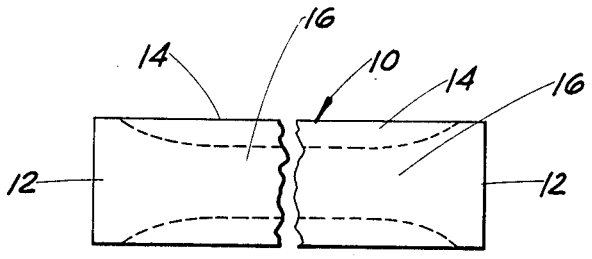
FIG. 1 is a schematic fragmentary longitudinal sectional view through the center of a preferred embodiment of a grinding rod in accordance with this invention.

Referring to FIG. 1, a preferred embodiment of a grinding rod of the invention is indicated generally at 10. It will be understood that grinding rods of the type under consideration are of elongated cylindrical configuration and may be fabricated from high carbon or alloy steel. The diameters typically range from about 75 to about 112.5 mm, and the lengths vary from about 3 to about 6.4 meters.

When heat treated in accordance with the method of the present invention, a grinding rod as illustrated in FIG. 1 has end portions indicated at 12 which are substantially pearlitic and hence have a hardness characteristic of a substantially pearlitic microstructure. When made from high carbon steel the hardness of the end portions 12 ranges from about 35 to about 50 on the Rockwell C scale.

Throughout the remaining length of the rod intermediate the end portions 12 is an annular outer region or shell indicated at 14 in FIG. 1 which is of substantially fully martensitic microstructure having a surface hardness greater than 50 on the Rockwell C scale and preferably ranging from about 55 to about 60. The annular outer region 14 occupies from about 40% to about 80% of the cross sectional area of the intermediate region of the rod.

The remainder of the rod intermediate the end portions constitutes a core region 16 having a hardness characteristic of a pearlitic microstructure. When fabricated from high carbon steel the core region has a hardness of about 30 to about 45 on the Rockwell C scale. Thus the core region 16 may be somewhat softer than the end portions 12 due to minor amounts of quench water traveling along the rod surface toward the end portions, creating a wash effect which cools the end portions 12 somewhat more rapidly than the core region 16.

In the embodiment of FIG. 1 it will be noted that the end portions 12 include the entire base surfaces of the cylindrical rod and regions immediately adjacent the base surfaces, these regions merging gradually into the annular outer shell 14 of substantially martensitic microstructure which is of uniform depth throughout the intermediate portion of the rod.

Figure 2:
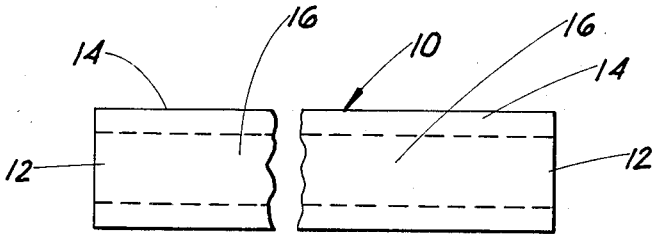
FIG. 2 is a schematic fragmentary longitudinal sectional view through the center of a further embodiment of a grinding rod in accordance with this invention.

In the embodiment of FIG. 2, which results from applying quench water nearly out to each end of the rod, the martensitic annular outer region 14 extends uniformly to each end of the rod, with the end portions 12 of pearlitic hardness occupying substantially the same area as the core region 16. The hardness values for the embodiment of FIG. 2, when fabricated from high carbon steel, are substantially the same as those indicated above for the embodiment of FIG. 1.

Figure 3:
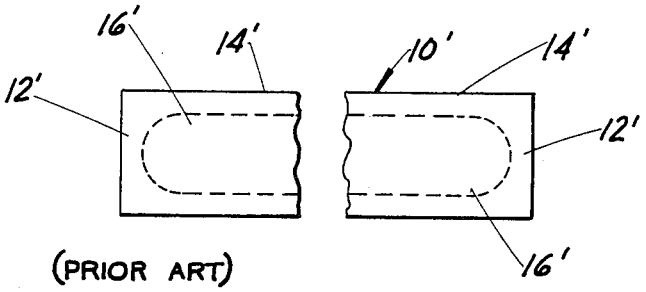
(PRIOR ART) FIG. 3
FIG. 3 is a schematic fragmentary longitudinal sectional view through the center of a prior art grinding rod.

For purposes of comparison, a grinding rod made in accordance with prior art practice is illustrated in Fig. 3, which is a fragmentary longitudinal sectional view through the center of a rod in the same manner as FIGS. 1 and 2. The prior art rod indicated at 10' in FIG. 3 may be produced, e.g., by a heat treatment method described in U.S. Pat. No. 3,170,641, issued Feb. 23, 1965 to A. L. Bard et al, wherein rod heated above the A3 point is passed through a series of annular nozzles through which a quench medium is caused to impinge upon the surfaces of the rod uniformly throughout its length, the rod being caused to rotate about its axis as it is moved through the series of annular nozzles. U.S. Pat. No. 3,170,641 discloses means for ensuring straightness of the quenched grinding rods, and such means preferably are used in the present process, although of course not forming a part of this invention. As a result of uniform quenching throughout its length, the typical prior art grinding rod has a substantially fully martensitic microstructure over all surfaces, including the end portions 12' and the intermediate portions 14'. A core 16' of pearlitic microstructure is confined entirely within the end portions, and the depth of the martensitic region in end portions 12' is substantially the same or deeper than the depth of the martensitic shell 14' intermediate the ends.

As an example of the practice of the present invention, a high carbon steel melt containing about 0.7% carbon, about 0.8% manganese, about 0.2% silicon, about 0.15% molybdenum, about 0.2% chromium and remainder essentially iron (all percentages being by weight), was cast and fabricated by hot working in conventional manner into a monolithic cylindrical grinding rod of 87.5 mm diameter. The rod was heated in a furnace to a temperature above the $A_3$, within the range of 760° to 960° C., preferably about 860° C. After quenching in accordance with the method of the present invention to be described in more detail hereinafter, the surface hardness of the martensitic annular outer region or shell 14 FIG. 1 was 58 Rockwell C, while the end portions 12 had a Rockwell C hardness of 40, and the core region 16 had a Rockwell C hardness of 35. The depth of the martensitic microstructure in the intermediate portions of the rod was about 17 mm, so that the martensitic area in the portions of the rod intermediate the end portions occupied about 49% of the cross-sectional area.

For rods of larger diameter the molybdenum and chromium contents would ordinarily be increased to a maximum of about 0.35% and about 0.4%, respectively, for greater hardenability. A broad range for high carbon steel rods would thus be from about 0.6% to about 1% carbon, about 0.7% to 1% manganese, about 0.1% to 0.4% silicon, about 0.15% to about 0.35% molybdenum, about 0.2% to about 0.4% chromium, and balance essentially iron.

Within the above composition ranges the minimum surface hardness of a quenched martensitic microstructure would be about 50 on the Rockwell C scale, with a preferred range of 55 to 60 Rockwell C. The maximum hardness for a pearlitic microstructure in a high carbon steel is about 45 to 50 on the Rockwell C scale.

After a rod emerges from the last quench zone, the surface temperature will be substantially below the $M_s$ temperature and may be as low as about 100° C. The core will be substantially above the $M_s$ temperature, e.g. the core could be about 370° C. Within a few minutes after quenching has been completed this temperature differential will equalize due to heat transfer within the rod. It is a feature of the method of the present invention to use either the surface temperature immediately upon emergence from the last quench zone or the equalization temperature to adjust the rate of travel of the rod through the quenching zones in order to ensure that the surface temperature is substantially below the $M_s$ point upon exiting the last quench zone. Utilizing the equalization temperature, typical operating conditions are summarized in Table I. It will be noted that the cross-sectional area occupied by martensite is within the desired limits of 40 to 80% for each of the three rod diameters, thus indicating proper rate of travel for the rods through the quenching zones.

TABLE I

| Rod Diameter (mm) | % Martensite Cross-Sectional Area | Equalization Temp (°C.) | Line Speed (m/min.) |
|---|---|---|---|
| 75 | 53 | 246–260 | — |
| 87.5 | 50 | 260–274 | 2.40 |

TABLE I-continued

| Rod Diameter (mm) | % Martensite Cross-Sectional Area | Equalization Temp (°C.) | Line Speed (m/min.) |
|---|---|---|---|
| 112.5 | 53 | 260–274 | 2.34 |

While the detailed description above is specific to carbon steel grinding rods ranging from about 75 to about 112.5 mm diameter, the invention is not so limited, and extends to rods of different compositions and different diameters which may be heat treated in such manner as to have a substantially uniform hardness throughout its thickness intermediate the end portions of generally lower hardness. Thus, in diameters up to about 25 mm, it would be possible to quench the intermediate portion at a rate sufficient to transform both the annular outer region and the core region to a substantially fully martensitic microstructure while the end portions have a hardness characteristic of a subsantially pearlitic microstructure. Similarly, for compositions which would not undergo transformation to martensite, phase changes which result from cooling rates selected to provide a desired microstructure could be obtained in selected regions of bar, tube or rod products.

Figure 4:
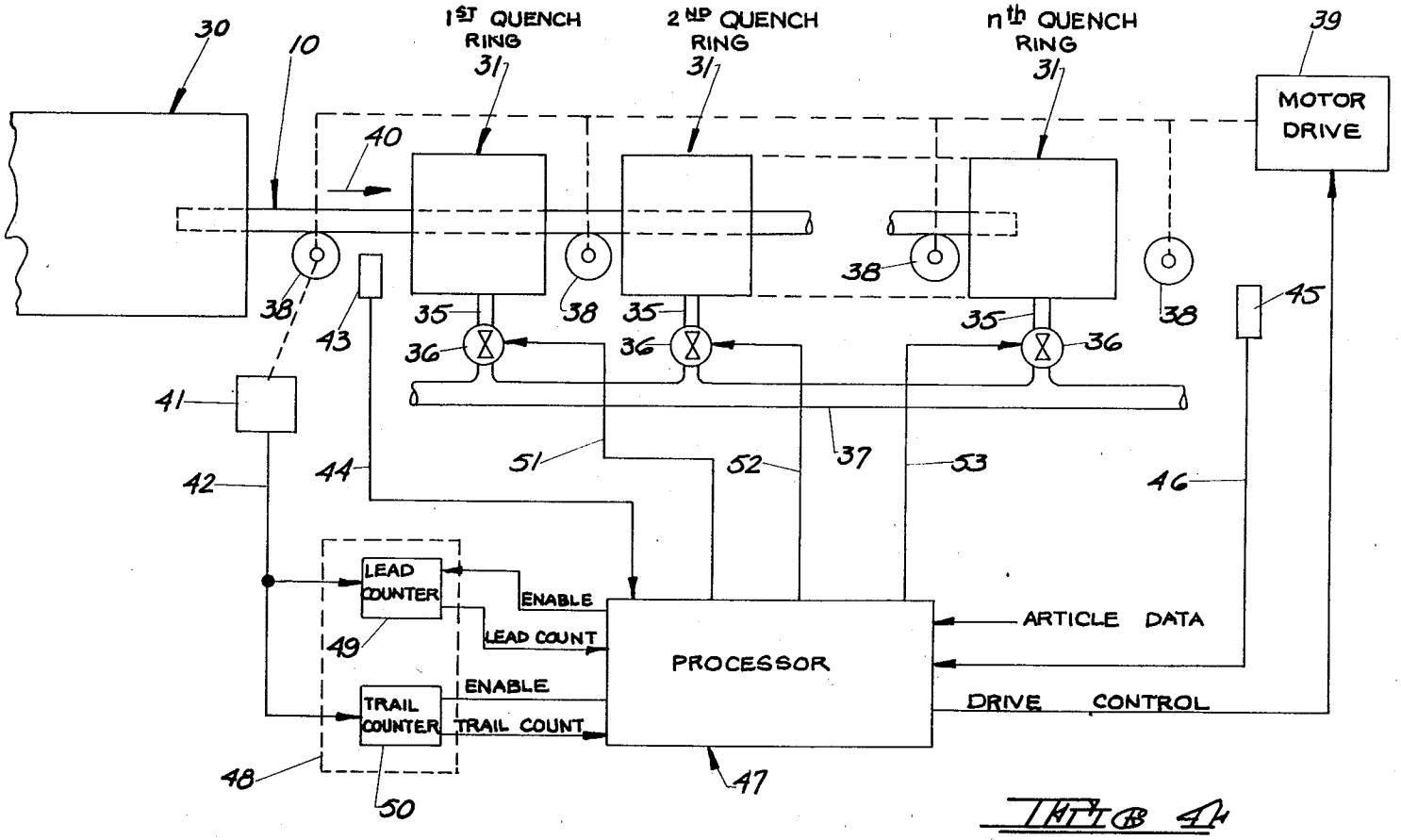
FIG. 4 is a schematic block diagram illustrating the method of the invention.

Turning next to a detailed discussion of the method of the invention, a preferred apparatus for carrying out variable quenching is illustrated schematically in FIG. 4. After the elongated metallic articles 10, which may be bars, rods, pipe, tube or the like, have been heated to a desired temperature by means of a suitable furnace or the like indicated generally at 30, they are passed longitudinally through one or more successive axially aligned liquid quench zones, each zone including a quench spray assembly 31, which may be of substantially identical construction.

Figure 5:
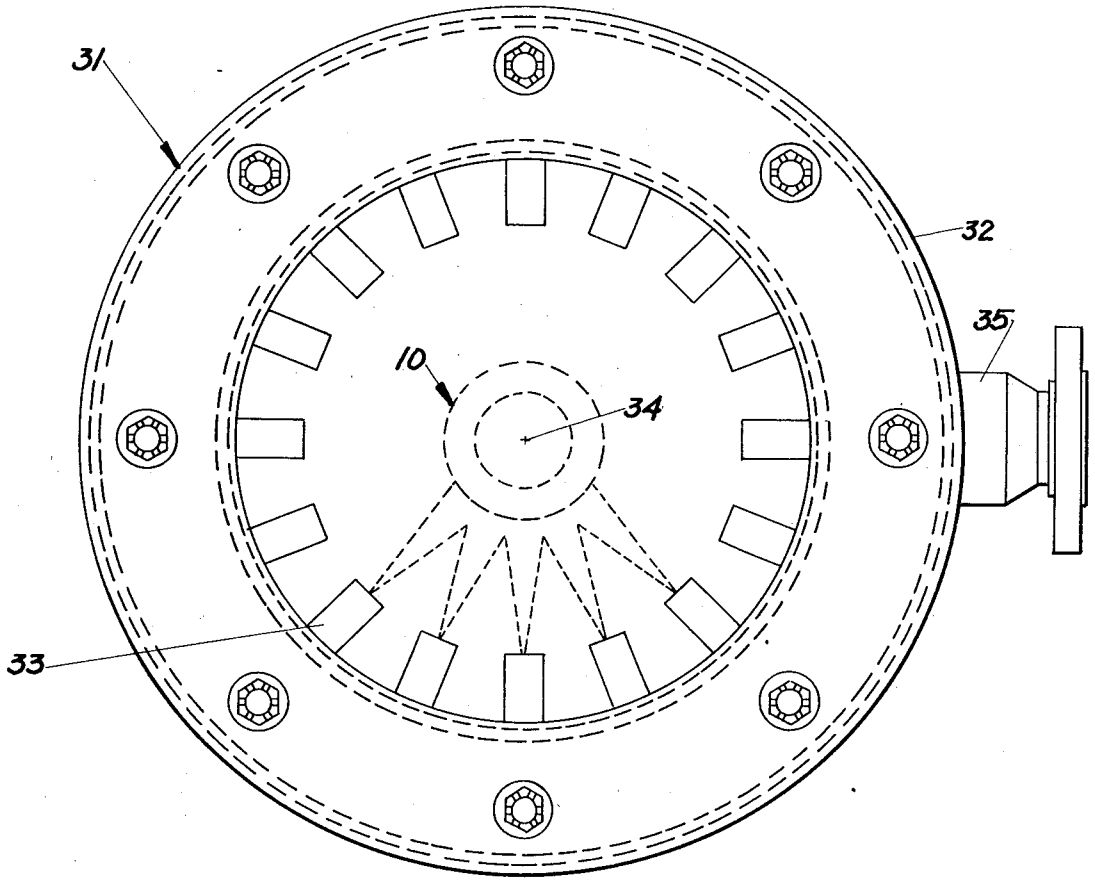
FIG. 5 is an end view of a quench ring used in the method of the invention.

A typical quench spray head 31 is illustrated in end view in FIG. 5 and includes a cylindrical housing 32 supporting a plurality of circumferentially spaced radially inwardly directed fan spray nozzles, one of which is illustrated at 33. Nozzles 33 are oriented so as to produce a spray pattern converging at and preferably substantially perpendicular to the longitudinal axis 34 of spray head 31. As illustrated in FIG. 5, the spray pattern from the spray nozzles is such as to completely cover the outer surface of an elongated metallic article 10 moving longitudinally along axis 34.

Water or other cooling fluid may be provided to spray nozzles 33 by means of a hollow inlet conduit 35 which communicates with all of the spray nozzles. Flow to the inlet conduit may be controlled either in an on/off or proportional manner by an electrically operated valve or the like 36. A suitable cooling fluid may be provided to each of valves 36 by a main fluid supply conduit 37. It will be observed that as many quench rings 31 may be provided as necessary to produce the desired surface temperature of the elongated metallic article 10, for example, as described hereinabove, to insure that the surface temperature is below the $M_s$ point. In the embodiment illustrated in FIG. 4, the quench ring 31 nearest the furnace 30 exit has been designated the first quench ring, the quench ring 31 next removed from the furnace 30 exit the second quench ring, and so forth, with the last quench ring 31 farthest from the furnace exit being designated the nth quench ring.

Elongated metallic articles 10 are supported by and moved in a generally horizontal direction from furnace 30 preferably through a plurality of liquid quench zones by means of a plurality of horizontally spaced skewed pass line rollers 38 which also rotate the articles, the rollers 38 being driven by means of a suitable variable speed motor drive 39 which operates to move the elongated articles 10 through the quench zones at a predetermined speed in the direction of arrow 40. The speed of rotation of rollers 38 and consequently the linear speed of travel of elongated metallic articles 10 is sensed by means of a suitable position encoder 41 which produces an electrical signal, such as individual pulses, on line 42 proportional to the distance of travel of the elongated metallic articles 10.

A position detector 43, which may be a pyrometer or other type of heat or light detector, is positioned near the exit of furnace 30. As will be explained in more detail hereinafter, position sensor 43 serves to detect the leading and trailing edge of each elongated metallic article 10. For example, in the preferred embodiment wherein position sensor 43 comprises a pyrometer, the sensor will detect the increased heat associated with the leading edge of the article 10 which may be translated to a positive-going pulse, and may also serve to detect the decrease in heat energy at the trailing edge of the article which may be translated to a negative-going pulse. Consequently, the seminal and terminal end of each article may be accurately defined by a corresponding electrical output signal on line 44.

A second sensor 45, which may also be a pyrometer, may be used. If so, it should be located at the exit of the nth quench ring and serves to monitor the temperature of the emerging article 10 by producing on output line 46 an electrical signal corresponding to the article temperature.

In the embodiment illustrated in FIG. 4, signal processing is handled by means of a processor shown generally at 47 which may be a general purpose digital computer, and in particular a microprocessor-based computer. As will be explained in more detail hereinafter, processor 47 operates to monitor the position of each elongated metallic article 10 and to enable or disable the appropriate quench ring for providing the cooling characteristics described hereinabove.

A pair of counters 48, which may be included as an integral part of processor 47, is assigned to each metallic article 10 moving through the quenching system under control of processor 47. In the preferred embodiment illustrated, counter pair 48 comprises a lead counter 49 which operates to monitor the position of the leading end of article 10 based on electrical signals appearing on position encoder output line 42, and a trail counter 50 which operates to monitor the trailing edge of the same article 10 in response to electrical signals appearing on position encoder output line 42. The actual count of each counter corresponding to the position of an article 10, as well as signals for enabling the counters, are provided as outputs and inputs, respectively, for processor 47.

In one preferred embodiment, position encoder 41 operates to produce an electrical pulse for each revolution of pass line rollers 38, which corresponds to a predetermined linear length of travel of the article 10. Counter pairs 48 then operate to count the number of pulses. For example, four revolutions of the pass line rollers 38 could be equated to one inch of article travel.

Electrical signals appearing on position sensor output line 44 and temperature sensor output line 46 are also provided as input data to processor 47. In addition, article data establishing the proper initial conditions is also provided as an input to the processor.

Output signals from processor 47 appear on signal lines 51–53 and operate to enable or disable in an on/off or proportional control fashion the respective quench ring valve 36.

Although not required, a drive control output signal may be provided from processor 47 to change the speed of motor drive 39 in order to modify the speed at which the articles 10 move through the quench rings. As will be explained in more detail hereinafter, speed of travel of the article will be adjusted to compensate for too low or too high temperatures of the quenched article as sensed by temperature sensor 45 at the exit from the nth quench ring. Speed of travel can also be adjusted manually.

In the quenching of grinding rods, processor 47 operates to initiate a liquid quench spray in the first quench zone or quench ring after the leading end of the rod has emerged therefrom, and to turn off the liquid spray in the first quench zone before entry of the trailing end of the rod thereinto. Similar operation occurs in each successive quench zone as the leading or trailing end of the rod emerges. As noted hereinabove, successive operation of the quench zones results in relatively slow cooling of the leading and trailing ends of each rod to attain a hardness characteristic of a substantially pearlitic microstructure, while the portion of the rod intermediate the ends attains a surface hardness greater than 50 on the Rockwell C scale due to rapid cooling, and the core region has a hardness characteristic of a pearlitic microstructure.

Figure 6A:
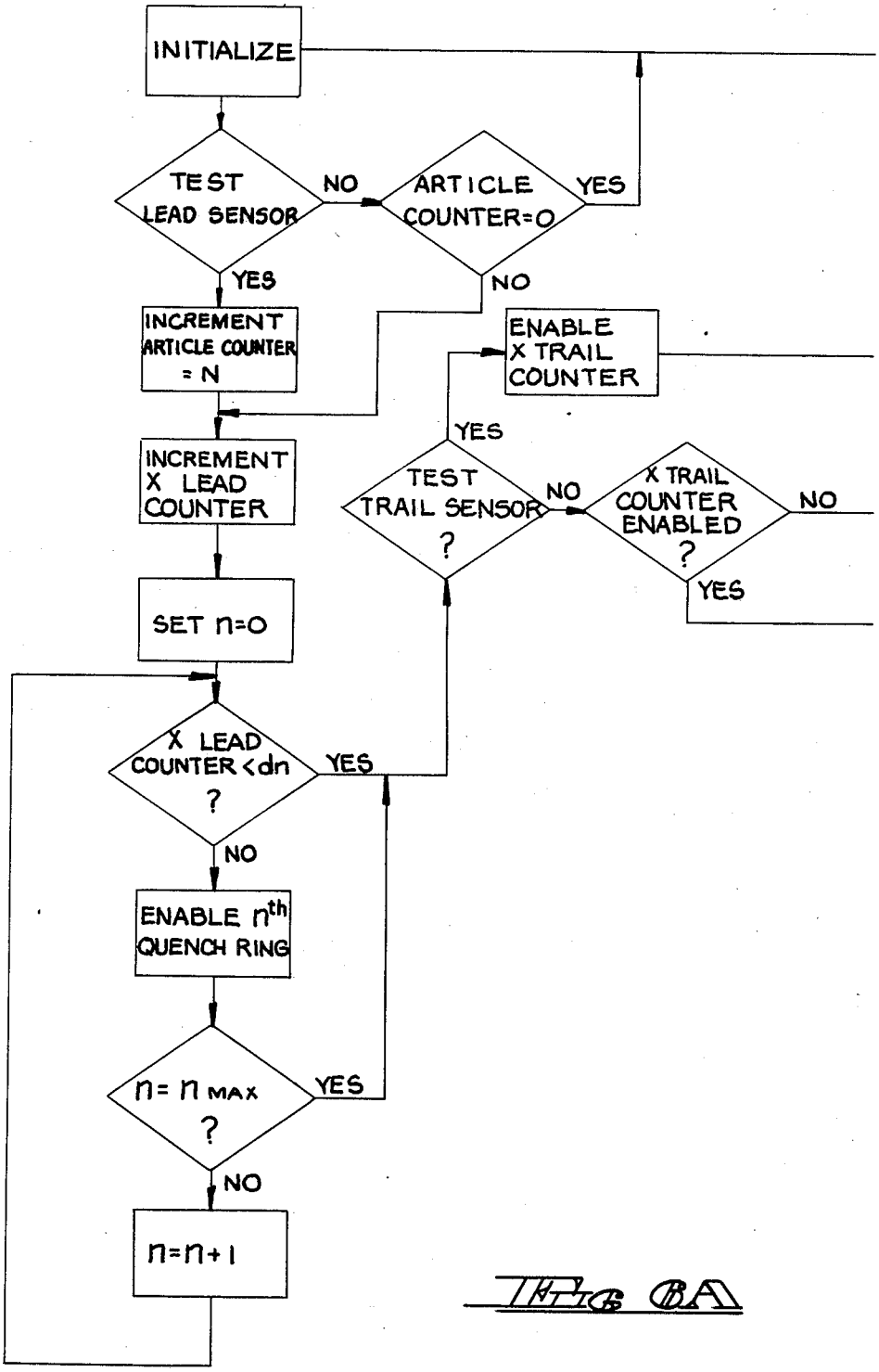
FIGS. 6A and 6B are a flow diagram illustrating the method of the invention for producing grinding rods.
Figure 6B:
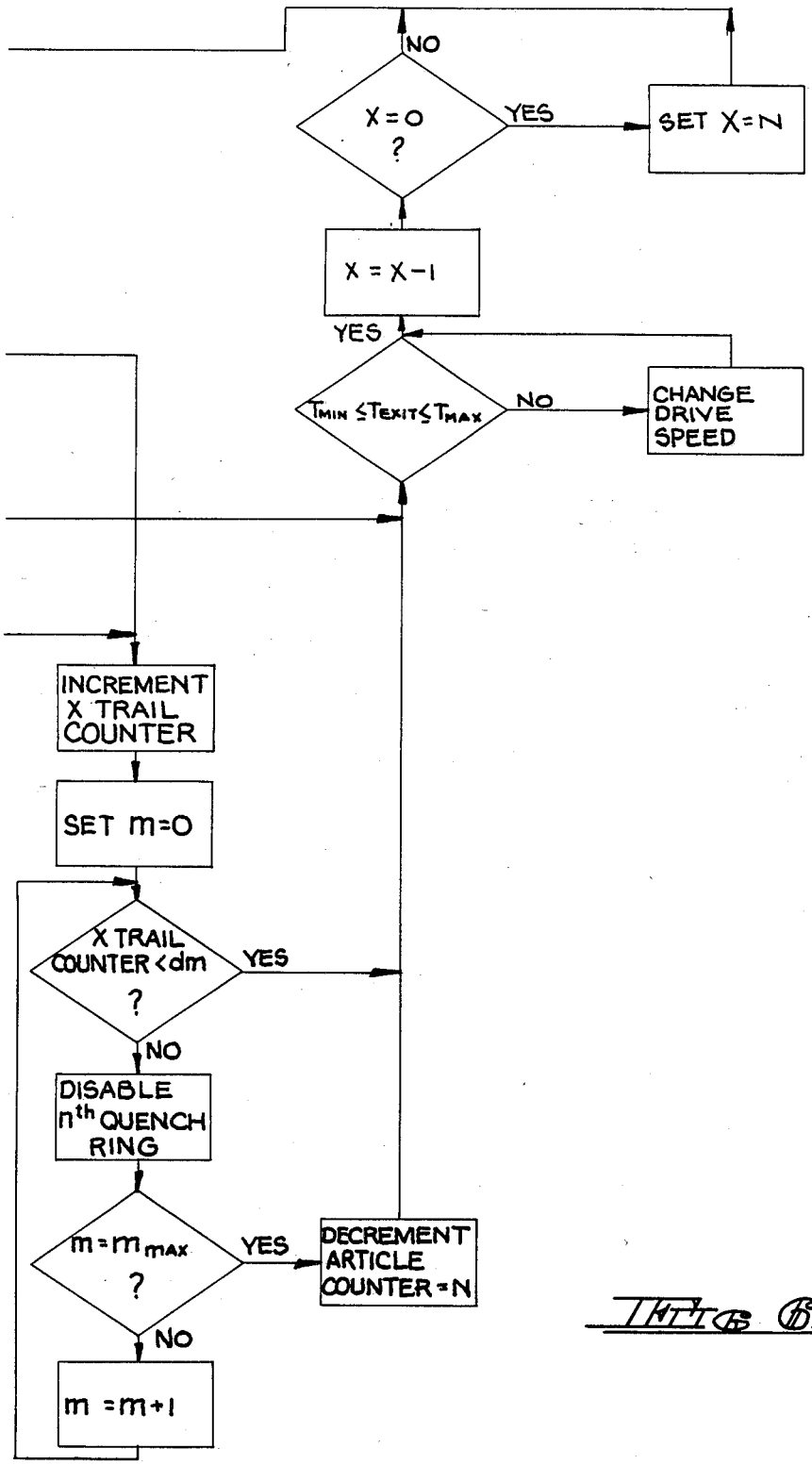

Exemplary means for programming microprocessor 47 to accomplish the above operation is illustrated in the flow diagram of FIGS. 6A and 6B. The system is initialized to set the various counters to be described hereinafter to their proper starting states. A test is then made to determine if the leading end of a rod has been detected by position sensor 43. If no leading end is detected, and an internal counter indicates that no rods are currently moving through the quench ring sequence, a holding loop is entered. Exit from the loop occurs when the leading end of a rod is detected, whereupon the rod counter is set to $N=1$.

As noted above, each rod 10 moving through the quenching system is assigned a counter pair 48. In the present implementation, the counter pair associated with the first rod is designated $X=1$, the counter pair associated with the second article $X=2$, and so forth. As noted in the flow diagram of FIGS. 6A and 6B, the lead counter 49 associated with the first counter pair ($X=1$) is enabled and incremented by pulses from position encoder 41 to establish an increasing count corresponding to the linear position of the rod.

A counter internal to processor 47 is set so that $n=0$, and the lead count output from lead counter 49 tested to determine if the count is less than a specified count $d_n$ associated with the turn on point for a particular quench ring. For example, the turn on point for the first quench ring might be established at a count of $d_1=30$. If the first lead counter value is less than this value, the loop exits. However, if the established count $d_1$ has been exceeded, the negative branch is taken and the first quench ring enabled. It will be observed that this loop continues to enable subsequent quench rings at successive counts of $d_2$, $d_3$, etc. until the nth quench ring has been reached, whereupon an exit is made to test the status of the trail sensor. In this manner, the liquid quench spray in each of the quench zones may be turned on at a particular linear position associated with the leading end of the rod. In the preferred embodiment described hereinabove, the various $d_n$ positions will be established so that the corresponding quench ring spray will be enabled at a point after the leading end of the rod has emerged from the associated quench ring.

Following enablement of the appropriate quench ring sprays, a test is made to determine whether the trail end of the rod has been detected by position sensor 43. If this has not occurred, a test is made to determine if x trail counter 50 has been previously enabled. If not, a test is made to determine whether the exit temperature $T_{EXIT}$ of a rod emerging from the nth quench ring lies between predetermined limits $T_{min}$ and $T_{max}$, respectively. If the temperature of the emerging rod is outside of these limits, a control signal on the DRIVE CONTROL line is sent to motor drive 39 to change the speed of the rods progressing through the quench rings. For example, if the sensed temperature is too high, the speed of travel of the rods will be reduced. Conversely, if the sensed temperature is too low, the speed of travel of the rods will be increased. No change in speed will occur if the sensed temperature is within the predetermined limits. The processing then continues by establishing conditions for testing the next counter pair, if any.

In the event that the trailing end of a rod is detected, a positive branch from TEST TRAIL SENSOR will enable the trailing counter 50 associated with the X counter pair. A similar branch will be followed if the X trail counter has been previously enabled. X trail counter 50 will then be enabled and incremented by pulses appearing on position encoder output line 42 corresponding to increasing distance of the trailing end of the rod from position sensor 43.

The counter internal to processor 47 is set to $m=0$, and the count of the X trail counter 50 examined to determine if it is less than a predetermined value $d_m$. The values $d_1, d_2 \ldots d_m$ each correspond to the position of a particular quench ring, and establish the points at which the associated quench ring spray is to be disabled. The processing in this loop follows a similar sequence to that described hereinabove with respect to the enablement of the successive quench rings. Consequently, the liquid spray in each quench zone will be turned off after the trailing end of the rod has entered the associated zone. The values of $d_m$ for each zone may be established so that the quench spray is turned off before the trailing end actually enters the quench ring so that the appropriate trailing length of the rod will have a hardness characteristic of a substantially pearlitic microstructure.

When $m=m_{max}$, indicating that the last quench ring has been turned off for a particular rod, the rod counter will be decremented to indicate the actual number of rods actually moving through the quenching system. The system then returns to track the actual position of the remaining rods, if any, by means of the counts established in lead counter 49 and trail counter 50, respectively for each of the counter pairs 48.

While for purposes of an exemplary showing, processor 47 has been implemented by means of counter pairs associated with the lead and trail ends of rods, it will be understood that various other methods and means may be utilized to monitor the actual position of an elongated metallic article within the quenching system. In addition, it will be understood that processor 47 may be programmed to provide complete turn on or turn off of the associated electrically operated valve 36, or may control these valves in a proportional manner to provide predetermined zones of variable quenching at any desired points along the article length. Thus, for articles other than grinding rods, the quench spray may be initiated in each zone before the leading end of the article has emerged from each zone; the spray may then be turned off after a predetermined length of the article has passed into each zone; the spray may next be turned on again after a further predetermined length of the article has passed into each zone and may finally be turned off after the trailing end of the article has entered each quench zone. The linear speed of travel may also be adjusted by detecting the temperature of the article at some point along the length thereof (ordinarily where it has been quenched) after passage of that point through the last quench zone so as to obtain a desired rate of quenching.

Although a preferred embodiment includes a pyrometer 43 positioned near the exit of furnace 30, as described above, it is within the scope of the method of the invention to utilize mechanical means to detect the position of the leading end of a metallic article and to initiate a liquid spray qench after a predetermined linear length of travel of the article in response to detection of the position of the leading end. For example, a pair of proximity switches could be provided for each quench zone, with a contact in front of each zone and a contact immediately after each zone. When an elongated metallic article, moving through a zone, contacts both switches the quench spray would be turned on. When the trailing end of the article clears the first contact in front of the quench zone, this would deactivate the circuit and turn off the quench spray (prior to entry of the trailing end of the article into the quench zone).

It will be understood that the method described above in its broad aspect is applicable to the variable quenching of elongated metallic articles of uniform cross-sectional area of various types such as bars, rods, pipe, tube and the like which may be heated to a desired temperature and quenched at a variety of locations along the length thereof to develop desired metallurgical or physical properties.

Further modification involves provision of a single quench ring of short axial length, particularly for small diameter pipe or rod. The article would be passed very slowly through the quench ring, with liquid spray being turned on after the leading end has emerged from the ring and being turned off as the trailing end approaches the ring. Movement of the article may be continuous or intermittent in any of the above described embodiments.

If only one product length were being produced, a quench ring could be provided of a length such that only the leading and trailing ends of the article project beyond the ends of the ring. The heated article would be held stationary (except for optional rotation) until quenching is complete, and the article would then be removed.

We claim:

1. A grinding rod for use in a rotating grinding mill comprising a monolithic, elongated, cylindrical, high carbon or alloy steel member the end portions of which have a hardness characteristic of a substantially pearlitic microstructure and ranging from about 35 to 50 on the Rockwell C scale, the remainder of said member intermediate said end portions comprising an annular outer region and a core region, at least said outer region being a substantially fully martensitic microstructure having a surface hardness greater than 50 on the Rockwell C scale.

2. The rod claimed in cliam 1, comprising a monolithic high carbon steel member containing about 0.6% to about 1% carbon, about 0.7% to 1% manganese, about 0.1% to 0.4% silicon, about 0.15% to about 0.35% molybdenum, about 0.2% to about 0.4% chromium, and balance essentially iron, all percentages being by weight, wherein the surface hardness of said outer region ranges from about 51 to about 65 on the Rockwell C scale.

3. The rod claimed in claim 2, wherein the surface hardness of said outer region ranges from about 55 to about 60 on the Rockwell C scale, and wherein the hardness of said core region ranges from about 30to about 45 on the Rockwell C scale.

4. The rod claimed in claim 3, wherein the hardness of said end portions ranges from about 35 to about 45 on the Rockwell C scale.

5. The rod claimed in claim 1 having a diameter ranging from about 75 to about 12.5 mm, wherein said annular outer region occupies from about 40% to about 80% of the cross-sectional area of said remainder of said member.

6. The rod claimed in claim 5, wherein said end portions include the entire base surfaces of said cylindrical member, and regions immediately adjacent said base surfaces which merge gradually into said annular outer region of hardness greater than Rockwell C 50.

7. The rod claimed in claim 5, wherein said annular outer region of high hardness extends into said end portions and occupies about 40% to about 80% of the base surfaces of said cylindrical member.

8. The rod claimed in claim 1, wherein said rod has a diameter up to about 25 mm, and wherein said core region has a substantially fully martensitic microstructure.

9. A method for selective quenching of an elongated high carbon or alloy steel article of uniform cross-sectional area, comprising the steps of heating said article to a desired temperature, continuously passing said article in a linear path of travel through at least one liquid quench zone, detecting the position of the leading end of said article prior to entering said liquid quench zone, initiating a liquid quench spray in said quench zone after the leading end of said article has emerged therefrom and after a predetermined linear length of travel of said article responsive to said step of detecting the position of said leading end, and turning off said liquid spray in said quench zone before entry of the trailing end of said article thereinto.

10. The method claimed in claim 9, wherein a plurality of substantially horizontal, successive, axially aligned quench zones is provided, including the steps of repeating said initiating step in each subsequent liquid quench zone after the leading end of said article has emerged from each zone, and repeating said turning off step in each said subsequent quench zone before said trailing end of said article has entered each said zone.

11. The method claimed in claim 9, including the step of detecting the temperature of said article intermediate the ends thereof after passage of said article at least partially through said liquid quench zone, and adjusting the linear speed of travel of said article relative to said temperature whereby to obtain a desired selected rate of quenching.

12. A method of producing heat treated grinding rods, comprising the steps of providing a monolithic, high carbon or alloy steel elongated cylinder, heating said cylinder above the $A_3$ point continuously, passing said cylinder in a linear path of travel at a predetermined speed through a plurality of successive, axially aligned water quench zones, initiating a water spray in the first of said quench zones after the leading end of said cylinder has emerged therefrom, turning off said water spray in said first quench zone before entry of the trailing end of said cylinder thereinto, repeating said initiating step in each subsequent water quench zone after said leading end of said cylinder has emerged from each said zone, repeating said turning off step in each said subsequent water quench zone before said trailing end of said cylinder has entered each said zone, detecting the position of said leading end of said cylinder prior to entering the first of said water quench zones, and initiating said water spray in each of said quench zones after a predetermined linear length of travel of said cylinder responsive to said step of detecting the position of said leading end.

13. The method claimed in claim 12, including the steps of detecting the temperature of said cylinder intermediate the ends thereof after passage of said cylinder at least partially through the last of said water quench zones, and adjusting said predetermined speed relative to said temperature whereby to ensure that the surface temperature of said cylinder intermediate the ends thereof is below the $M_s$ point.

14. The method claimed in claim 12, wherein said trailing end of said cylinder enters said first quench zone before said leading end emerges from said last quench zone, and including the steps of detecting independently the position of said trailing end, and turning off said water spray in each of said qench zones after a further predetermined linear length of travel of said cylinder responsive to said step of detecting independently the position of said trailing end.

15. The method claimed in claim 12, wherein a plurality of said cylinders is passed in succession in said linear path of travel in spaced relation such that the leading end of a second cylinder enters said first quench zone before the trailing end of a first cylinder emerges from the last said quench zone, and including the steps of detecting independently the position of said leading end of said second cylinder, and initiating said water spray in each of said quench zones after a predetermined linear length of travel of said cylinder responsive to said step of detecting independently the position of said leading end of said second cylinder.

16. The method claimed in claim 13, wherein said cylinder is formed from high carbon steel containing from about 0.6% to about 1% carbon, and wherein said cylinder is heated from about 760° to about 960° C.

17. The method claimed in claim 16, wherein said leading and trailing ends of said cylinder, after passage through said last quench zone, have a hardness ranging from about 35 to 50 on the Rockwell C scale, and said cylinder intermediate said ends has a surface hardness greater than 50 on the Rockwell C scale and a core region having a hardness ranging from about 30 to about 45 on the Rockwell C scale, said core region occupying about 20% to about 60% of the cross-sectional area of said cylinder.

* * * * *

UNITED STATES PATENT AND TRADEMARK OFFICE

CERTIFICATE OF CORRECTION

PATENT NO. : 4,589,934

DATED : May 20, 1986

INVENTOR(S) : Robert J. Glodowski and Vernon C. Van Slyke

It is certified that error appears in the above—identified patent and that said Letters Patent is hereby corrected as shown below:

In column 11, line 21, the number "12.5" should be deleted and replaced with the number --112.5--.

Signed and Sealed this

Twentieth Day of December, 1988

*Attest:*

DONALD J. QUIGG

*Attesting Officer*

*Commissioner of Patents and Trademarks*